US006179141B1

(12) United States Patent
Nakamura

(10) Patent No.: US 6,179,141 B1
(45) **Date of Patent: *Jan. 30, 2001**

(54) CONTAINER ASSEMBLY PROVIDED WITH ANITBACTERIAL AGENT AGAINST SLOW-LEAK BACTERIA

(76) Inventor: Kenji Nakamura, 3-41 Nishiawaji 6-chome Higashiyodogawa-ku, Osaka (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/692,752

(22) Filed: Aug. 6, 1996

(51) Int. Cl.[7] ..... B65D 51/16; B65D 53/02

(52) U.S. Cl. ..... 215/352; 215/261; 215/308; 215/347

(58) Field of Search ..... 215/40, 341, 348, 215/349, 347, 352, 350, 308, 261; 220/378

(56) References Cited

U.S. PATENT DOCUMENTS 1,713,948 * 5/1929 Carbalho ..... 215/352
3,618,814 * 11/1971 Nagroski ..... 220/378
4,700,860 * 10/1987 Li ..... 215/341 X
4,811,855 * 3/1989 Bergstrom et al. ..... 215/243
4,852,754 * 8/1989 Holdsworth et al. ..... 215/347
4,911,898 * 3/1990 Hagiwara et al. ..... 423/118
4,911,899 * 3/1990 Hagiwara et al. ..... 423/118
4,981,231 * 1/1991 Knight ..... 215/341
5,381,914 * 1/1995 Koyama et al. ..... 215/341
5,496,860 * 3/1996 Matsumoto et al. ..... 521/31
5,532,431 * 7/1996 Saka et al. ..... 215/341 X
5,542,557 * 8/1996 Koyama et al. ..... 215/347
5,685,443 * 11/1997 Taber et al. ..... 215/342
5,997,815 * 12/1999 Anders et al. ..... 422/35

* cited by examiner

*Primary Examiner*—Allan N. Shoap
*Assistant Examiner*—Niki M. Eloshway
(74) *Attorney, Agent, or Firm*—Knobbe, Martens, Olson & Bear, LLP

(57) ABSTRACT

A container assembly provided with an antibacterial agent against "slow-leak" bacteria, comprising a container such as a plastic bottle which has a mouth portion having a rim; and a seal member such as a crown cap fitted to the mouth portion at the rim, wherein at least either a surface portion of the rim or the rim-contacting surface portion of the seal member includes an antibacterial agent such as silver zeolite in the form of a coating or a liner, thereby effectively blocking the entry of unwanted live bacteria and eumycetes which may enter the interior of the container assembly due to slow-leak.

15 Claims, 5 Drawing Sheets

CONTAINER ASSEMBLY PROVIDED WITH ANITBACTERIAL AGENT AGAINST SLOW-LEAK BACTERIA

BACKGROUND

1. Field of the Invention

This invention relates to an airtight container assembly which prevents bacterial contamination caused by "slow-leak", i.e., unwanted bacteria slowly enter the interior of the container assembly through small gaps between a sealing member and a mouth portion of the container assembly when the seal between the seal member and the mouth portion is inferior. In particular, this invention relates to a container assembly provided with an antibacterial agent for preserving the contents of the container assembly even when slow-leak occurs.

2. Background of the Art

Heretofore, in order to aseptically pack a beverage such as a juice, juice drink, coffee, tea, milk drink, drinking water, and other non-carbonated soft drinks in a container assembly, hot-packing is conducted. For example, by heating to a temperature of 82° to 85° C. for fruit drink, 85° C. to 90° C. for coffee or tea, and 70° C. to 75° C. for mineral water, sterilization of the contents and the interior of the container assembly is conducted. After hot-packing of the contents in the container assembly, the container assembly is capped immediately, and then normally subjected to overturning-sterilization, in which the container assembly is overturned so as to sterilize the neck portion of the container assembly. In the above processes, capping is conducted when the temperature of the contents is high, i.e., the air present inside the container assembly is expanded, and thus, as the contents cool, the pressure of the interior of the container assembly is reduced because the cap liner and the rim of the mouth portion are airtightly sealed. However, when the airtight seal between the cap liner and the rim of the mouth portion is inferior, although no liquid leaks, the outside air containing unwanted bacteria enters the interior of the container assembly through small gaps therebetween, i.e., "slow-leak" occurs. Slow-leak may occur in situations other than in hot-packing. For example, during storage of container assemblies, due to a change in volume of the contents corresponding to a change in surrounding temperature, the outside air containing unwanted bacteria tends to enter the interior of the container assemblies.

When slow-leak occurs, not only air but also various bacteria and eumycetes enter the interior and cause the contents to deteriorate. Since slow-leak occurs very slowly, it is extremely difficult to detect occurrence. Once it is detected, all of the products produced in the same line or in the same lot as that of the detected product often must be abandoned because tracing slow-leak is time-consuming and unfeasible. This is a very serious and costly problem. Causes of slow-leak may be slight scratches on the rim of the mouth portion of a container assembly, or bruising a cap. These defects render the seal between the cap liner and the rim of the mouth insufficient. There is no significant solution to fully eliminate such defects, and in general, one per ten thousand to one million container assemblies is consistently identified as a slow-leak container assembly.

As described above, causes of slow-leak may be (a) a small gap between the cap liner and the rim of the mouth portion due to scratches on the surface of the rim; (b) a bruise caused during transportation of container assemblies, i.e., an edge of the cap is bumped; and (c) a seal defected caused by defective capping operation. In any case, small gaps are unavoidably formed through which not only outside air but also unwanted bacteria enter the interior of container assemblies, as the inside pressure is lower than that of the outside, resulting in contaminated contents.

SUMMARY OF THE INVENTION

The present invention has exploited container assemblies to prevent accidental contamination of contents in an airtight container assembly. An objective of the present invention is to provide a container assembly which allows for prevention of entry of unwanted live bacteria and eumycetes into the interior of the container assembly, even when slow-leak occurs.

Namely, one important aspect of the present invention is a container assembly provided with an antibacterial agent against slow-leak bacteria, comprising: a container which has a mouth portion having a rim, said rim having a sealing-surface portion; and a seal member fitted to said mouth portion at said rim, said seal member having a rim-contacting surface portion which is in contact with said sealing-surface portion of said rim, wherein at least either said sealing-surface portion or said rim-contacting surface portion includes an antibacterial agent. In the present invention, as an antibacterial agent, a silver-containing inorganic antibacterial agent is preferred. In the gaps which may be formed between the seal member and the rim of the mouth portion, an antibacterial agent is present, thereby effectively blocking entry of unwanted live bacteria and eumycetes into the interior of the container assembly due to the antibacterial action effected by silver ions which are generated from the antibacterial agent and present at the gaps. According to the present invention, contamination of contents of a container assembly can be prevented completely.

In the above container assembly for blocking entry of slow-leak bacteria, said rim-contacting surface portion may be made of a coating layer or a lining layer including an antibacterial agent. The sealing member may be a metal crown cap, and the coating layer may be made by applying a coating material comprising an antibacterial agent to a metal sheet from which said sealing member is stamped out. Alternatively, the sealing member may be a plastic cap, and the lining layer is made by injection-molding of a lining material containing an antibacterial agent. In addition, in the container assembly of the present invention, the sealing member may comprise a packing sheet including an antibacterial agent.

Further, in the container assembly for slow-leak bacteria, the sealing-surface portion of the rim may be made of a coating layer or a lining layer including an antibacterial agent. In the above, the container may be made of glass or plastic, and the coating layer may be made by applying a coating material comprising an antibacterial agent, to the mouth portion which has been molded. Alternatively, the container may be made of plastic, and the lining layer may be made by injection-molding of a lining material comprising an antibacterial agent.

In the above, the antibacterial agent is included in at least either the dealing-surface portion, or the rim-contacting surface portion preferably in an amount of 0.5% to 10% by weight based on the weight of the respective portions.

A silver-containing inorganic antibacterial agent is preferred and may be at least one selected from the group consisting of silver zeolite, silver zirconium phosphate, silver apatite, and silver complex salt, but most preferably silver zeolite.

BRIEF DESCRIPTION OF THE FIGURES

FIG. 1 is a schematic view showing an embodiment of a crown cap usable in the present invention, in which a synthetic resin comprising an antibacterial agent, which is formed into a doughnut-shaped liner by press-molding, is attached to the inner surface of the crown cap.

DETAILED DESCRIPTION OF THE PREFERRED EMBODIMENTS

Figure 1B:
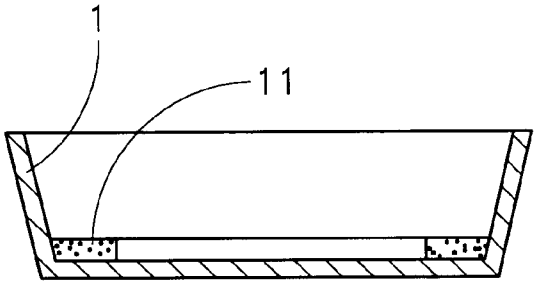
FIG. 1B is a cross-sectional view.

In the present invention, as a container, a bottle made of plastic, glass, or metal may be used. Any other containers having a mouth portion having a rim and which can be airtightly sealed may be used. As a seal member, a cap or a crown cap made of plastic or metal may be used. Any other seal members, which can airtightly seal the mouth portion of the container, may be used. A container assembly may accommodate various types of solution, emulsion, and particulate, which require a protection against bacteria. For example, the contents in the container assembly may be beverages such as a juice, juice drink, coffee, tea, milk drink, soft drink, drinking water, and other non-carbonated soft drinks, or cosmetics such as a lotion, milky lotion, and cream. The container and the seal member are sealed at the sealing-surface portion of the container and the rim-contacting surface portion of the seal member. These portions can be separate portions or integrated portions. For example, a rim-contacting surface portion can be a packing sheet or an inner pad provided inside the seal member. As an antibacterial agent, a silver-containing inorganic antibacterial agent is preferred in view of nontoxicity, food-hygienic safety, none volatile components, stability, and long term effectiveness of antibacterial action. A silver-containing inorganic antibacterial agent may be exemplified by silver zeolite, silver zirconium phosphate, silver apatite, and silver complex salt, all of which are food-hygienically usable. However, silver zeolite is most preferable since the generation level of silver ions is suitable and stable, as compared with that of silver zirconium phosphate, silver apatite, etc. In order to prevent color contamination with time, it is preferred to use silver zeolite accommodated inside porous silica capsules. An antibacterial agent must be present in at least either the rim-contacting surface portion of the seal member or the sealing-surface portion of the mouth portion of the container. The antibacterial agent can be present locally or fully incorporated in the surface portion(s). However, the antibacterial agent must be present at least in the vicinity of the actually contacting surfaces.

At least either the rim-contacting surface portion or the sealing-surface portion includes an antibacterial agent, and is referred to as an antibacterial layer. The antibacterial layer may be present in the form of a coating or a liner, and may be made of coating material, binder, packing material, rubber elastomer, or synthetic resin constituting a container, in which an antibacterial agent is included. The content of the antibacterial agent may be approximately in the range of 0.5% to 10%, preferably 1% to 5%, by weight based on the weight of the antibacterial layer.

A coating material, such as acrylic-epoxy synthetic resins, polyamine-epoxy synthetic resins, vinyl chloride-acrylic synthetic resins, polyurethane synthetic resins, styrene-acrylic synthetic resins, and acrylic-silicon synthetic resins, may include an antibacterial agent in an amount of 1% to 5% by weight. Other types of synthetic resins may also used. The coating material including the antibacterial agent can be applied to a contacting-surface of a natural or synthetic cork or a packing sheet, which is provided with a seal member, thereby effecting antibacterial action.

A binder, such as acrylic binders, vinyl chloride binders, and urethane binders, which are normally used as synthetic resin emulsions, may include an antibacterial agent in an amount of 1% to 5% by weight. A synthetic resin, such as PET, polypropylene, polyethylene, nylon, ABS, polyurethane, polyvinyl chloride, polyacrylate, polystyrene, which may constitute a container and/or a seal member, may include an antibacterial agent in an amount of 1% to 5% by weight, in which the synthetic resin including the antibacterial agent may be integrated into a seal member and/or a mouth portion of a container where the seal member and the mouth portion are in contact. A material for a cap liner, such as polyethylene, polypropylene, synthetic rubber, and silicon, which includes an antibacterial agent, may be formed into an expanded-foam-type sheet. A coating material or a binder including an antibacterial agent such as silver zeolite may be coated on the surface of a liner sheet. In any case, an antibacterial agent must be present at least in the vicinity of the very contacting surfaces. A part of the surface of a liner which does not contact the rim of the mouth portion of the container need not include an antibacterial agent.

EXAMPLE

Figure 1A:
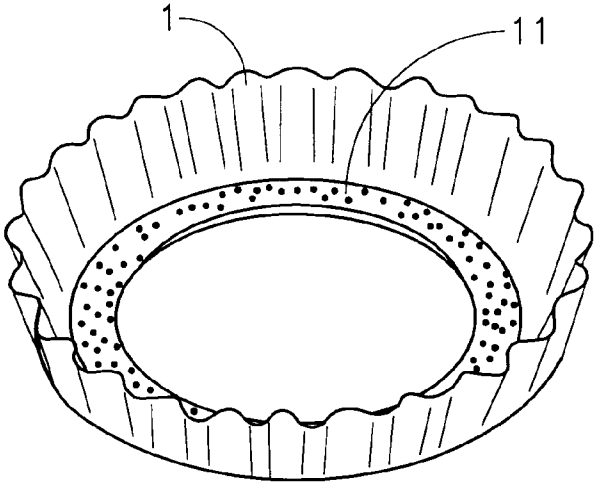
FIG. 1A is a perspective view.
Figure 2:
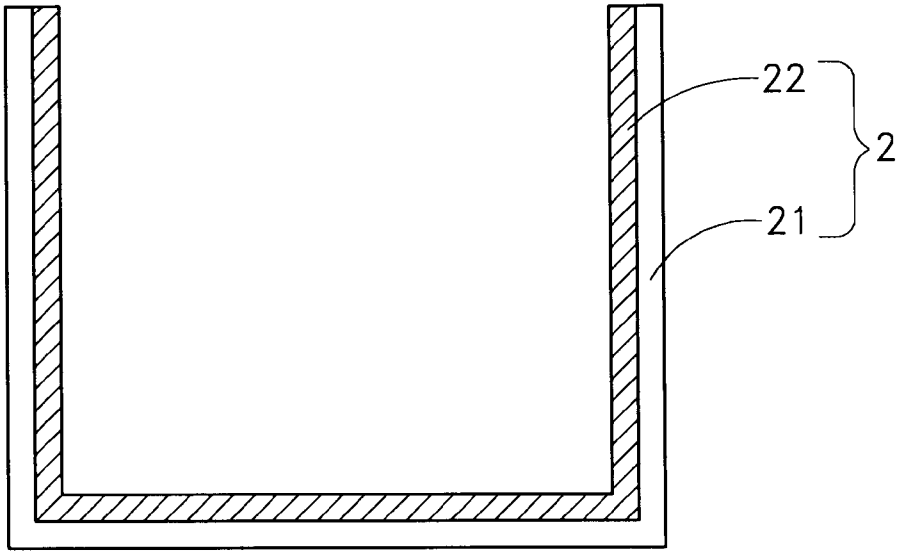
FIG. 2 is a schematic cross-sectional view showing an embodiment of a cap usable in the present invention, in which the cap is formed after applying a coating material comprising an antibacterial agent to the surface of an aluminum sheet.
Figure 3:
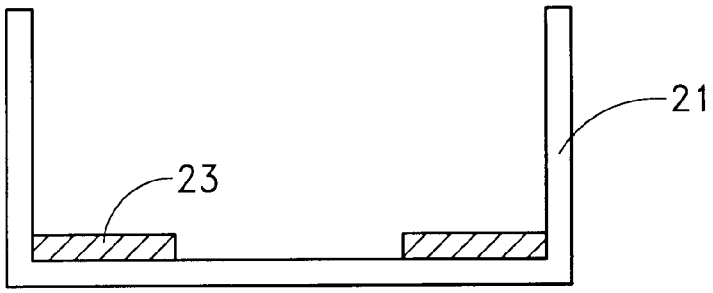
FIG. 3 is a schematic cross-sectional view showing an embodiment of a cap usable in the present invention, in which a liner comprising an antibacterial agent is attached to the inner surface of the cap after the cap is formed.
Figure 4:
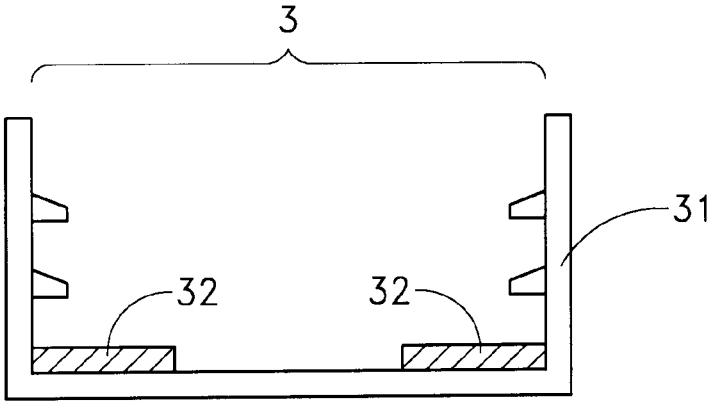
FIG. 4 is a schematic cross-sectional view showing an embodiment of a cap usable in the present invention, in which a liner comprising an antibacterial agent is formed on the inner surface of the cap when the cap is formed by injection-molding.
Figure 5:
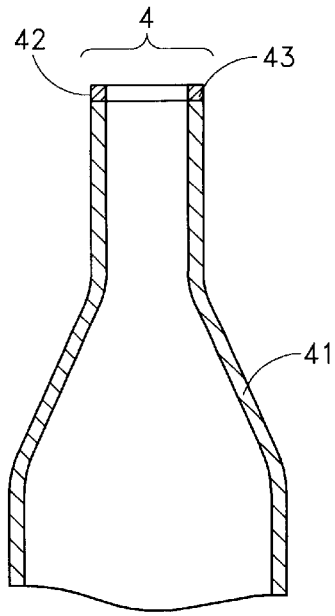
FIG. 5 is a schematic cross-sectional view showing an embodiment of a bottle usable in the present invention, in which a coating material comprising an antibacterial agent is applied to the rim of the mouth portion of the bottle.
Figure 6:
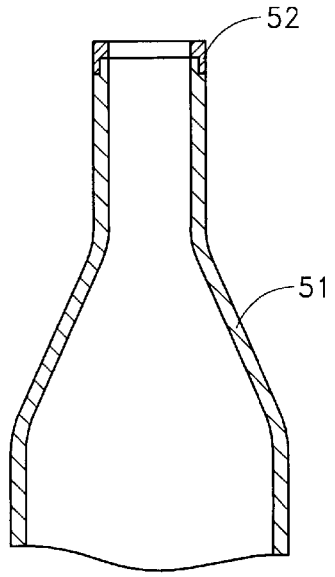
FIG. 6 is a schematic cross-sectional view showing a first embodiment of a bottle usable in the present invention, in which a synthetic resin comprising an antibacterial agent is integrated into the rim of the mouth portion of the bottle by injection-molding.
Figure 7:
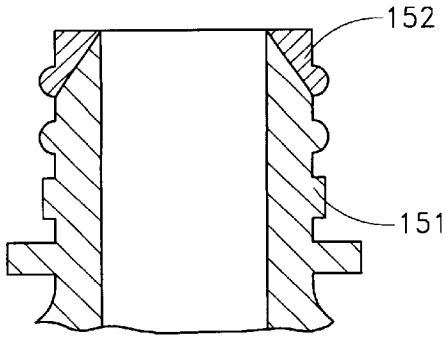
FIG. 7 is a schematic cross-sectional view showing a second embodiment of a bottle usable in the present invention, in which a synthetic resin comprising an antibacterial agent is integrated into the rim of the mouth portion of the bottle by injection-molding.
Figure 8:
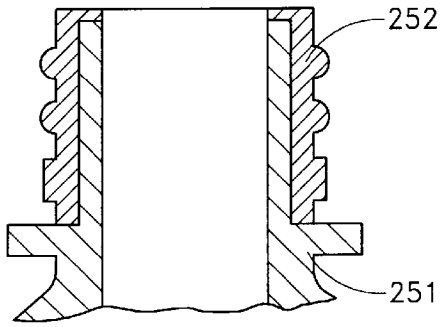
FIG. 8 is a schematic cross-sectional view showing a third embodiment of a bottle usable in the present invention, in which a synthetic resin comprising an antibacterial agent is integrated into the rim of the mouth portion of the bottle by injection-molding.
Figure 9:
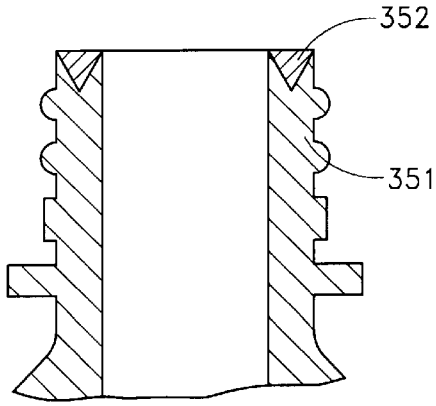
FIG. 9 is a schematic cross-sectional view showing a fourth embodiment of a bottle usable in the present invention, in which a synthetic resin comprising an antibacterial agent is integrated into the rim of the mouth portion of the bottle by injection-molding.

Hereinafter, by referring to FIGS. 1–9, the present invention will be further explained. The present invention can exhibit advantageous antibacterial effects associated with the aspects depicted in these figures. However, the present invention is not limited to these aspects. In FIG. 1, a polyethylene sheet 11 including silver zeolite is fixed to the inner surface of a crown cap 1 by press-molding. In FIG. 2, a coating material 22 including silver zeolite is applied to the surface of an aluminum sheet 21, and then the aluminum sheet is shaped into an aluminum cap 2. In FIG. 3, after forming a cap 2, the inner surface of the cap is subjected to lining treatment using polyethylene including silver zeolite to form a liner 23. In FIG. 4, in the case of a plastic cap 3, when molding a cap 31, a liner 32 made of resin including silver zeolite is integrated into the inner surface of the cap by injection. This process is performed as a part of the cap-making processes. For example, by delaying the timing of injection after forming a cap, lining is conducted by fixing a resin 32 including silver zeolite as a liner on the inner surface of the cap. In FIG. 5, the rim of a bottle 4 is processed, in which the upper rim 43 of a formed bottle 41 is coated with a coating material 42 including silver zeolite. Coating can be conducted by conventional methods. In FIG. 6, after forming a bottle 51, using other injection material, i.e., synthetic resin including silver zeolite, a dual structure 52 is formed at the rim of the mouth by delaying the timing of injection. FIGS. 7–9 show examples of such a dual structure, in which a liner is integrated into a mouth. In FIG. 7, a lining material 152, which is integrated into a mouth 151, covers a rim portion including the outward edge. In FIG. 8, a lining material 252, which is integrated into a mouth 251, covers a rim portion including the side portion where a screw portion of a cap is fitted. In FIG. 9, a lining material 352, which is integrated into a mouth 351, covers a rim portion including the top most surface where a cap is in contact. In these figures, the lining material, whose base material may be the same as that of the container, can be formed by injection-molding so as to fully integrate the material into the mouth when producing the container. Alternatively, the lining material, whose base material may be different form that of the container, can be formed separately from the container and then fitted into the mouth.

EXPERIMENT 1

Using an expanded-foam polyethylene sheet (expansion of five magnifications) having a thickness of 0.9 mm, which contained 2% silver zeolite, a doughnut-shaped liner having an external diameter of 28 mm and an internal diameter of 18 mm was stamped out. The liner was fixed to the inner surface of a cap having an internal diameter of 28 mm. A hundred PET container assemblies, each having had the rim of the mouth portion scratched with sand paper, were filled with milk-containing coffee by hot-packing at a temperature of 85° C., capped with the above caps, and then subjected to overturning-sterilization for 50 seconds. As control products, a hundred PET container assemblies, each having had the rim of the mouth portion scratched with sand paper, were filled with milk-containing coffee by hot-packing at a temperature of 85° C., capped with conventional caps having conventional liners made of expanded-foam polyethylene, and then subjected to overturning-sterilization for 50 seconds. The thus-obtained container assemblies were stored at room temperature for three weeks, and then cultured at a temperature of 38° C. for 24 hours. The number of bacteria cultured in each container assembly was measured. As a result, no bacterium was detected in the container assemblies of the present invention, in which silver zeolite was included in the cap liner, while $4\times10^5$–$6\times10^5$/ml of bacteria were detected in 10% of the control container assemblies, i.e., ten control container assemblies.

EXPERIMENT 2

A clear coating material using epoxy resin, which contained 2% silver zeolite, was applied to the rim of a mouth portion of each PET container assembly, and dried. A hundred of the above PET container assemblies, each having had the rim of the mouth portion scratched, were filled with orange juice by hot-packing at a temperature of 82° C., capped with conventional caps, and then subjected to overturning-sterilization for 50 seconds. As control products, a hundred conventional PET container assemblies, each having the rim of the mouth portion scratched, were filled with orange juice by hot-packing at a temperature of 85° C., capped with conventional caps, and then subjected to overturning-sterilization for 50 seconds. The thus-obtained container assemblies were stored in a room at room temperature for three weeks, and then cultured at a temperature of 38° C. for 24 hours. The number of bacteria cultured in each container assembly was measured. As a result, no bacterium was detected in the container assemblies of the present invention, in which the rim of each was coated with the coating material containing silver zeolite, while $1\times10^7$–$3\times10^7$/ml of bacteria were detected in 8% of the control container assemblies, i.e., eight control container assemblies.

It will be understood by those of skill in the art that numerous variations and modifications can be made without departing from the spirit of the present invention. Therefore, it should be clearly understood that the forms of the present invention are illustrative only and are not intended to limit the scope of the present invention.

We claim:

1. A container assembly provided with an antibacterial agent against slow-leak bacteria, said container assembly having an interior and being adapted to contain material susceptible to bacteria, comprising, a container which has a mouth portion having a rim, said rim having a sealing-surface portion; and a seal member fitted to said mouth portion at said rim, said seal member having a rim-contacting surface portion which is in contact with said sealing-surface portion of said rim, said rim contacting surface portion and said sealing surface portion being in contact at a contacting area, wherein said contacting area allows entry of slow-leak bacteria therethrough while the pressure of the interior is reduced, said contacting area including silver zeolite as an antibacterial agent in an amount of 0.5%–10% by weight based on the weight of said sealing-surface portion, said silver zeolite being present substantially exclusively in said contacting area to prevent contamination of the container material with slow-leak bacteria.

2. The container assembly provided with an antibacterial agent according to claim 1, wherein said sealing-surface portion of said rim is made of a coating layer and said antibacterial agent is included in said sealing-surface portion.

3. The container assembly provided with an antibacterial agent according to claim 2, wherein said container is made of a glass or plastic material, said coating layer is made by applying a coating material comprising said antibacterial agent to said mouth portion which has been molded.

4. The container assembly provided with an antibacterial agent according to claim 1, wherein said sealing-surface portion of said rim is made of a lining layer and said antibacterial agent is included in said sealing-surface portion.

5. The container assembly provided with an antibacterial agent according to claim 4, wherein said sealing-surface portion of said rim is integrated into said mouth portion.

6. The container assembly provided with an antibacterial agent according to claim 4, wherein said sealing-surface portion of said rim is fitted to said mouth portion.

7. The container assembly provided with an antibacterial agent according to claim 4, wherein said container is made of a plastic, and said lining layer is made by injection-molding a lining material comprising said antibacterial agent.

8. The container assembly provided with an antibacterial agent according to claim 1, wherein said silver zeolite is accommodated inside porous silica capsules.

9. A container assembly provided with an antibacterial agent against slow-leak bacteria, said container assembly having an interior and being adapted to contain material susceptible to bacteria, comprising, a container which has a mouth portion having a rim, said rim having a sealing-surface portion; and a seal member fitted to said mouth portion at said rim, said seal member having a rim-contacting surface portion which is in contact with said sealing-surface portion of said rim, said rim contacting surface portion and said sealing surface portion being in contact at a contacting area, wherein said contacting area allows entry of slow-leak bacteria therethrough while the pressure of the interior is reduced, said contacting area including silver zeolite as an antibacterial agent in an amount of 0.5%–10% by weight based on the weight of said rim-contacting surface portion, said silver zeolite being present substantially exclusively in said contacting area to prevent contamination of the container material with slow-leak bacteria.

10. The container assembly provided with an antibacterial agent according to claim 9, wherein said rim-contacting surface portion is made of a coating layer and said antibacterial agent is included in said rim contacting surface portion.

11. The container assembly provided with an anitbacterial agent according to claim 10, wherein said seal member is a metal crown cap, and said coating layer is made by applying a coating material comprising said antibacterial agent to a metal sheet from which seal sealing member is stamped out.

12. The container assembly provided with an antibacterial agent according to claim 9, wherein said rim-contacting surface portion is made of a lining layer and said antibacterial agent is included in said rim contacting surface portion.

13. The container assembly provided with an antibacterial agent according to claim 12, wherein said seal member is a plastic cap, and said lining layer is made by injection-molding a lining material containing said antibacterial agent.

14. The container assembly provided with an antibacterial agent according to claim 9, wherein said seal member comprises a packing sheet, said rim-contacting surface portion being part of said packing sheet, and said antibacterial agent is included in said packing sheet.

15. The container assembly provided with an antibacterial agent according to claim 9, wherein said silver zeolite is accommodated inside porous silica capsules.

* * * * *